US007445406B2

(12) United States Patent
Ortlepp

(10) Patent No.: US 7,445,406 B2
(45) Date of Patent: Nov. 4, 2008

(54) ROCK BOLT

(75) Inventor: William David Ortlepp, c/o SRK House, P.O. Box 55291, 265 Oxford Road, Illovo, Johannesburg 2196 (ZA)

(73) Assignees: Steffen, Robertson & Kirsten (South Africa) (Pty) Ltd., Illovo (ZA); William David Ortlepp, Illovo (ZA)

( * ) Notice: Subject to any disclaimer, the term of this patent is extended or adjusted under 35 U.S.C. 154(b) by 39 days.

(21) Appl. No.: 10/505,592

(22) PCT Filed: Feb. 25, 2003

(86) PCT No.: PCT/ZA03/00032

§ 371 (c)(1),
(2), (4) Date: Apr. 19, 2005

(87) PCT Pub. No.: WO03/071098

PCT Pub. Date: Aug. 28, 2003

(65) Prior Publication Data

US 2005/0207851 A1 Sep. 22, 2005

(30) Foreign Application Priority Data

Feb. 25, 2002 (ZA) ..... 2002/1531

(51) Int. Cl.
*E21D 20/00* (2006.01)

(52) U.S. Cl. ..... 405/259.1; 405/259.5

(58) Field of Classification Search ..... 405/258.1, 405/259.1, 259.5; 138/120, 121, 155; 285/223–237
See application file for complete search history.

(56) References Cited

U.S. PATENT DOCUMENTS 3,859,889 A * 1/1975 Fischer ..... 411/75
4,040,756 A * 8/1977 Donegan ..... 403/307
4,112,637 A * 9/1978 Herbst ..... 52/155
4,124,983 A * 11/1978 Weatherby ..... 405/259.5
4,257,155 A * 3/1981 Hunter ..... 29/511
4,415,294 A * 11/1983 Ringe ..... 405/259.1
4,440,526 A * 4/1984 Koppers et al. ..... 405/259.5
4,624,489 A * 11/1986 Nakamura ..... 285/382
4,630,971 A * 12/1986 Herbst et al. ..... 405/259.5
4,648,753 A * 3/1987 Stephan ..... 405/259.5
4,760,887 A * 8/1988 Jansson et al. ..... 173/132
4,850,746 A * 7/1989 Finsterwalder et al. ... 405/259.5
4,892,442 A * 1/1990 Shoffner ..... 405/183.5
5,400,994 A * 3/1995 Shawwaf et al. ..... 248/354.3

(Continued)

FOREIGN PATENT DOCUMENTS

EP 0015895 A 9/1980

(Continued)

*Primary Examiner*—Tara L. Mayo
(74) *Attorney, Agent, or Firm*—Fitch, Even, Tabin & Flannery; Norman N. Kunitz

(57) ABSTRACT

An anchor device which includes a pipe (16), an elongate member (18) which is partly inside the pipe and which has an end (20) which protrudes from the pipe (16), and a restraining component (22) which is engaged with the protruding end (20). The pipe (16) and the elongate member (18) are shaped with a plurality of deformations along their respective lengths such that the elongate member (18) can only be withdrawn from the tubular member (16) by further deforming the elongate member (18).

20 Claims, 1 Drawing Sheet

U.S. PATENT DOCUMENTS

| | | | | | |
|---|---|---|---|---|---|
| 5,443,331 | A | * | 8/1995 | Seegmiller | 405/259.1 |
| 5,472,296 | A | * | 12/1995 | von Allmen et al. | 405/233 |
| 5,525,013 | A | * | 6/1996 | Seegmiller et al. | 405/259.3 |
| 5,527,070 | A | * | 6/1996 | Blackwell | 285/45 |
| 5,586,839 | A | * | 12/1996 | Gillespie | 405/259.1 |
| 5,636,945 | A | * | 6/1997 | Nes | 405/259.1 |
| 5,669,199 | A | * | 9/1997 | Ludwig et al. | 52/704 |
| 5,775,849 | A | * | 7/1998 | Sorkin | 405/259.1 |
| 5,888,025 | A | * | 3/1999 | Papousek | 405/259.5 |
| 5,919,006 | A | * | 7/1999 | Calandra et al. | 405/302.2 |
| 6,270,290 | B1 | * | 8/2001 | Stankus et al. | 405/259.6 |
| 6,334,493 | B2 | * | 1/2002 | Linden | 173/1 |
| 6,394,190 | B2 | * | 5/2002 | Linden | 173/1 |
| 6,447,228 | B1 | * | 9/2002 | Fergusson | 411/82 |

FOREIGN PATENT DOCUMENTS

| | | | |
|---|---|---|---|
| EP | 0995878 | A | 4/2000 |
| GB | 1164007 | A | 9/1969 |
| GB | 1482899 | A | 8/1977 |
| SU | 1283411 | A | 1/1987 |
| WO | WO 9209789 | A | 6/1992 |
| WO | WO 9961749 | A | 12/1999 |

* cited by examiner

ROCK BOLT

CROSS REFERENCE TO RELATED APPLICATION

This application is the National Stage filing under 35 U.S.C. 371 of International Application No. PCT/ZA03/00032, filed Feb. 25, 2003, and claims priority of South African Patent Application 2002/1531, filed Feb. 25, 2002.

BACKGROUND OF THE INVENTION

This invention relates to an anchor device.

As used herein the expression "anchor device" designates a load carrying device which is capable of yielding in a controlled manner when the load on the device increases above a predetermined limit.

Without being restrictive in any way an anchor device, as defined, may be used as a rock bolt to reinforce a rock face or as a reinforcing element in a concrete structure such as a bridge or building.

SUMMARY OF INVENTION

According to a first aspect of the invention there is provided a method of forming an anchor device which includes the steps of:

(a) locating an elongate member at least partly within a tubular member; and (b) simultaneously deforming the elongate member and the tubular member at least at one location whereby withdrawal of the elongate member from the tubular member is inhibited.

At least a portion of the elongate member and of the tubular member may be deformed into a substantially sinusoidal shape.

The elongate member and the tubular member may be deformed at each of a plurality of locations which are spaced from each other in a longitudinal direction of the elongate member.

The method may include the step of securing a restraining component to an end of the elongate member which extends from the tubular member.

The tubular member may be at least one pipe and the elongate member may be selected from the following: a rod and a cable.

The invention also provides an anchor device which includes a tubular member, and an elongate member at least partly inside the tubular member, the tubular member and the elongate member being shaped, in a complementary manner, at least at one location whereby withdrawal of the elongate member from the tubular member is inhibited.

The arrangement may be such that the elongate member can only be withdrawn from the tubular member by deforming the elongate member.

The anchor device may include a restraining component at an end of the elongate member which protrudes from the tubular member.

The elongate member may be any appropriate element or elements and, for example, may be selected from a rod and a cable.

BRIEF DESCRIPTION OF THE DRAWING

The invention is further described by way of example with reference to the accompanying drawing wherein.

DESCRIPTION OF PREFERRED EMBODIMENT

Figure 1:
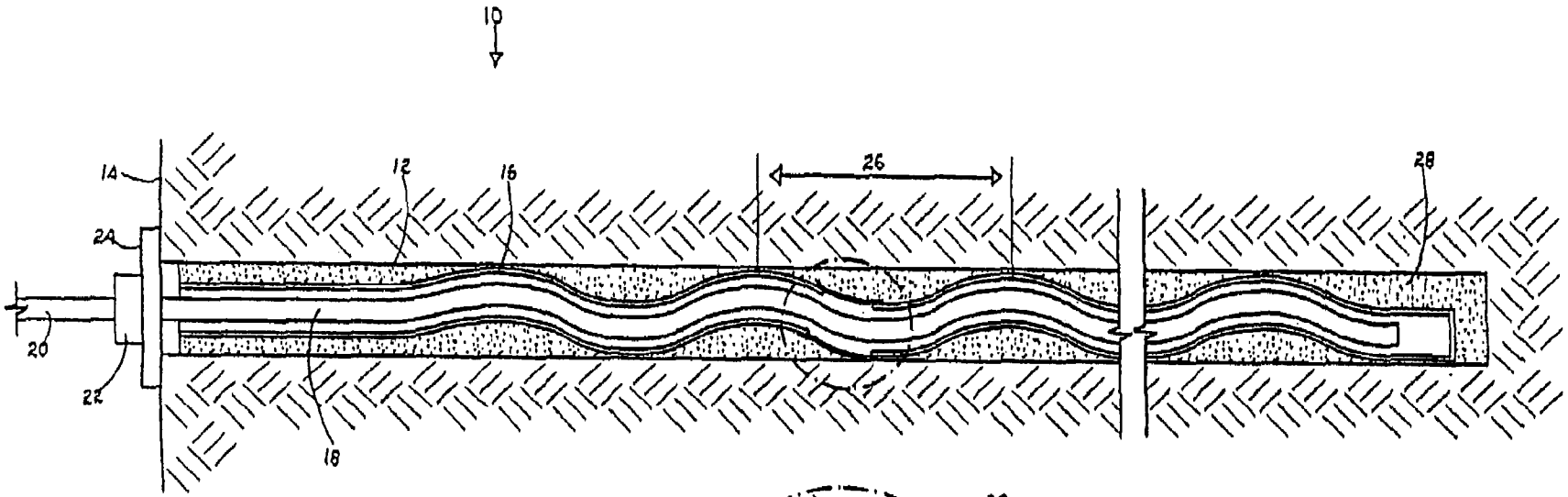
FIG. 1 depicts, from the side and in cross section, an anchor device according to the invention.
Figure 2:
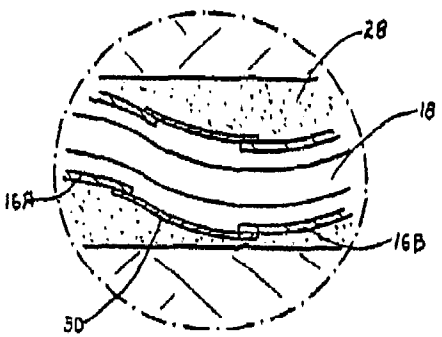
FIG. 2 is an enlarged detail view of the circled portion of FIG. 1.

The accompanying drawing illustrates from the side and in cross section an anchor device 10, according to the invention, installed in a hole 12 which is formed in a rock face 14.

The anchor device includes an elongate tubular member 16 which is in the nature of a thin wall steel pipe and an elongate load bearing member 18 which is inserted into the pipe with one end 20 protruding from the pipe.

The member 18 may be a steel rod or a cable.

A restraining component 22 is secured to the protruding end 20 and bears against a load distributing washer 24 which in turn acts against a surface of the rock face 14 which surrounds the hole 12.

The restraining device varies according to the nature of the elongate member 18. For example if the elongate member is a steel rod then the protruding end 20 may be threaded and the restraining component 22, which is then in the nature of a nut, is threadedly engaged with the end 20. Alternatively if the member 18 is a cable or is formed from a number of wires then the restraining component 22 may be in the nature of a lug or ferrule which is crimped onto the protruding end in situ at an installation site.

The anchor device 10 is formed, under factory conditions, by inserting the elongate member 18 into the pipe 16 when the pipe is of a regular shape ie. is not deformed. The pipe, which encloses the elongate member over a substantial portion of the length of the elongate member, is placed in a suitable press and is deformed in one or a plurality of steps into the shape shown in the drawing. The deformed pipe has peaks and troughs with a generally smooth transition between each peak and adjacent trough thereby imparting to the pipe an overall generally sinusoidal shape.

The undulations or sinusoidal peaks are spaced apart by a distance 26 which varies according to requirement.

The hole 12 is formed in the rock face using any appropriate technique known in the art and the anchor device 10 is placed in the hole with the pipe 16 embedded in grout or other settable material 28 which fills the hole. The settable material is normally injected into the hole using any suitable placement apparatus after the pipe has been inserted into the hole.

If the restraining component 22 is a nut then the washer and the nut are engaged with the protruding end 20 after the settable material is injected into the hole through its mouth. On the other hand if the restraining component is in the nature of a lug or similar device which is applied under factory conditions to the protruding end then the load distribution washer 24 may initially be displaced slightly from the rock face 14 to allow the settable material to be injected into the hole through its mouth or, alternatively, the washer 24 may have an aperture or passage formed through it and the settable material may be injected through the aperture or passage into the hole 12.

Ideally, once the material 28 has set, the component 22 is advanced along the member 18 to prestress the member. This may however not be possible if the component is crimped under factory conditions to the end 20. It is preferable therefore to attach the component to the end 20 in situ, at the installation location.

When the anchor device is embedded in the settable material, the material, whether grout, resin or of a different type, bonds to the exterior surface of the pipe which is thereby held firmly in position.

If there is movement of the rock face relatively to the bulk of the rock in which the hole 12 is formed then the load which is carried by the member 18 increases. The member 18 is therefore placed under increasing tensile stress. The rock face 14 can only move however when the load carried by the member 18 is so high that the element is deformed through the sinusoidal passage which is defined by the pipe 16. It is evident that the point at which yielding takes place is dependent on a number of factors including the material from which the elongate member is made, the dimensions and shape of the member, the clearance between the member and the inner wall of the pipe, and the number, depth and spacing of the formations in the pipe and the member.

The elongate member slides through the pipe by deforming as it passes through the undulations to provide a controlled yielding action with the pipe remaining behind and fully embedded in the settable material. An appropriate lubricant may be applied to the elongate member, before it is inserted into the pipe. This helps to ensure that a smooth sliding action takes place as yielding occurs, particularly if the yield rate is high ie. when the member 18 moves very rapidly, for example during a seismic event.

The length of the anchor device may be substantial. This makes the anchor device suitable for use in reinforced concrete applications for example in bridges and structures. With this type of application the member 18 will generally be a cable or comprise a plurality of high tensile winds which may be helically twisted, at least slightly. The installation and operation of the anchor device, in a reinforced concrete application, for all practical purposes, are the same as what has been described hereinbefore with reference to the use of the anchor device in a body of rock except that the device is cast in position.

The pipe 16 is rigid and if the anchor device is made to a substantial length it may be difficult to install the device particularly in an underground situation or in a location in which there is limited space. To impart a degree of flexibility to the anchor then, as is shown more clearly in the inset drawing, the member 18 may be a cable and the pipe 16 may comprise a plurality of relatively smaller lengths 16A, 16B, . . . which are separated from each other along the length of the cable by means of suitable spacers 30, which may be made from a flexible plastics material. Each individual pipe length is sinusoidally deformed, with the cable inside, in the manner which has been described and is fixed in position when it is embedded in the settable material. However, before installation, it is possible to bend or flex the anchor device, at least to a limited degree, by bending one pipe section to a limited extent relatively to an adjacent pipe section. The use of the spacers does not adversely affect the strength of the anchor device nor the yielding action thereof.

The invention claimed is:

1. A method of forming a rock anchor device which includes the steps of:

(a) locating an elongate substantially straight load bearing member partly within a substantially rigid tubular member which encloses one end of the elongate member over a portion of the length of the elongate member;

(b) securing a restraining component of the anchor device to an opposite end of the elongate member which extends from the tubular member at a location that is outside the tubular member; and (c) simultaneously deforming the elongate member and the tubular member at each of a plurality of locations to form respective deformations which are spaced from each other in a longitudinal direction of the elongate member so that withdrawal of the elongate member from the tubular member results in further deformation of the elongate member within the tubular member to provide a controlled yielding action; and wherein: the step of locating includes placing the elongated member in the tubular member such that they are capable of sliding movement relative to one another in the longitudinal direction; and said step of simultaneously deforming produces complementary deformations that cause the elongate member to no longer be straight and inhibit but do not destroy the relative sliding movement capability.

2. A method according to claim 1 wherein at least a portion of the elongate member and a portion of the tubular member are simultaneously deformed to produce complementary deformations having a substantially sinusoidal shape.

3. A method according to claim 1 wherein the elongate member and the tubular member are simultaneously deformed to have a plurality of peaks and troughs.

4. A method according to claim 1 wherein the tubular member includes at least one pipe.

5. A method according to claim 1 wherein the elongate member is one of a rod and a cable.

6. A method according to claim 1 wherein the complementary deformations cause the portion of the elongate member enclosed by the tubular member to have a substantially sinusoidal shape in a longitudinal direction.

7. An anchor device which includes a rigid tubular member, and an elongate load bearing member having one end inside the tubular member, which encloses the elongate member over a portion of the length of the elongate member, and a restraining component that is secured to an opposite end of the elongate member extending from the tubular member and at a location that is outside the tubular member, with the tubular member and the enclosed portion of the elongate member both being deformed, in a complementary manner, at each of a plurality of locations to form respective deformations which are spaced from each other in a longitudinal direction of the elongate member and with the shape of the complementary deformations being such that withdrawal of the elongate member from the tubular member is inhibited to provide a controlled sliding and yielding action; and wherein a lubricant is provided on the elongate member inside the tubular member.

8. An anchor device according to claim 4 wherein the deformed portion of the elongate member extends in a longitudinal direction with a substantially sinusoidal shape.

9. An anchor device according to claim 7 wherein the end of the tubular member adjacent said one end of said elongate member is closed.

10. An anchor device which includes a tubular member, and an elongate load bearing member having one end inside the tubular member, which encloses the elongate member over a portion of the length of the elongate member, and a restraining component that is secured to an opposite end of the elongate member extending from the tubular member and at a location that is outside the tubular member, with the tubular member and the enclosed portion of the elongate member both being deformed, in a complementary manner, at each of a plurality of locations to form deformations which are spaced from each other in a longitudinal direction of the elongate member and with the shape of the complementary deformations being such that withdrawal of the elongate member from the tubular member is inhibited to provide a controlled sliding and yielding action; and wherein the tubular member includes a plurality of pipes through which the elongate member passes.

11. An anchor device according to claim 10 wherein adjacent pipes are separated by flexible spacers.

12. An anchor device according to claim 10 wherein the deformed portion of the elongate member extends in a longitudinal direction with a substantially sinusoidal shape.

13. An anchor device which includes a rigid tubular member, and an elongate toad bearing member having one end inside the tubular member that includes a plurality of pipes through which the elongate member passes, with the tubular member and the elongate member being shaped, in a complementary manner, at each of a plurality of locations to form deformations which are spaced from each other in a longitudinal direction of the elongate member so that withdrawal of the elongate member from the tubular member is inhibited while providing a controlled sliding and yielding action when the tubular member is anchored and a predetermined load is applied to the elongate member; and wherein adjacent pipes are separated by flexible spacers.

14. An anchor device according to claim 13 wherein the deformed portion of the elongate member extends in a longitudinal direction with a substantially sinusoidal shape.

15. An anchor device which includes a tubular member, and an elongate load bearing member having one end inside the tubular member that includes a plurality of pipes through which the elongate member passes, with the tubular member and the elongate member being shaped, in a complementary manner, to form a plurality of deformations which are spaced from each other in a longitudinal direction of the elongate member so that withdrawal of the elongate member from the tubular member is inhibited while providing a controlled yielding action; and wherein the elongate member is retained in the tubular member only by the shaped complementary deformations which permit a sliding movement of the elongated member relative to the tubular member in the longitudinal direction after a predetermined load is exerted on the elongate member.

16. An anchor device according to claim 15 wherein the deformed portion of the elongate member extends in a longitudinal direction with a substantially sinusoidal shape.

17. An anchor device which includes a pipe, an elongate load bearing member which is partly inside and enclosed by the pipe and which has an end which protrudes from the pipe, and a restraining component which is engaged with the protruding end, and wherein the pipe and elongate member are shaped with a plurality of complementary sinusoidal deformations, along their respective lengths, so that the elongate member can only be withdrawn from the tubular member by further deforming the elongate member thereby to provide a controlled yielding action; and wherein the elongate member is retained in the tubular member only by engagement of the sinusoidal deformations of the elongate member and the tubular member so that a relative sliding movement of the elongated member and the tubular member is permitted in the longitudinal direction after a predetermined load is exerted on the elongate member.

18. An anchor device which includes a tubular member, and an elongate load bearing member having one end inside the tubular member, which encloses the elongate member over a portion of the length of the elongate member, and a restraining component that is secured to an opposite end of the elongate member extending from the tubular member and at a location that is outside the tubular member, with the tubular member and the enclosed portion of the elongate member both being deformed, in a complementary manner, at each of a plurality of locations to form deformations which are spaced from each other in a longitudinal direction of the elongate member and with the shape of the complementary deformations being such that withdrawal of the elongate member from the tubular member is inhibited to provide a controlled yielding action; and wherein the elongate member is retained in the tubular member only by the complementary deformations which permit a sliding movement of the elongated member relative to the tubular member in the longitudinal direction after a predetermined load is exerted on the elongate member.

19. An anchor device according to claim 18 wherein the elongate member is selected from a rod and a cable.

20. An anchor device according to claim 18 wherein the deformed portion of the elongate member extends in a longitudinal direction with a substantially sinusoidal shape.

* * * * *